US009175519B2

(12) United States Patent
Gylling

(10) Patent No.: US 9,175,519 B2
(45) Date of Patent: Nov. 3, 2015

(54) METHOD AND APPARATUS FOR COUPLING AN EARTH PIPE INTO THE GROUND, USING A SOLIDIFYING MASS

(75) Inventor: Kai Gylling, Tampere (FI)

(73) Assignee: Oy Atlas Copco Rotex Ab, Tampere (FI)

( * ) Notice: Subject to any disclaimer, the term of this patent is extended or adjusted under 35 U.S.C. 154(b) by 252 days.

(21) Appl. No.: 13/885,882

(22) PCT Filed: Nov. 1, 2011

(86) PCT No.: PCT/FI2011/050957
§ 371 (c)(1),
(2), (4) Date: May 16, 2013

(87) PCT Pub. No.: WO2012/059641
PCT Pub. Date: May 10, 2012

(65) Prior Publication Data

US 2013/0284515 A1 Oct. 31, 2013

(30) Foreign Application Priority Data

Nov. 3, 2010 (FI) ..... 20106154

(51) Int. Cl.
*E21B 7/20* (2006.01)
*E21B 33/14* (2006.01)

(52) U.S. Cl.
CPC .. *E21B 7/20* (2013.01); *E21B 33/14* (2013.01)

(58) Field of Classification Search
CPC ..... E21B 7/20; E21B 7/208
See application file for complete search history.

(56) References Cited

U.S. PATENT DOCUMENTS

| | | | | |
|---|---|---|---|---|
| 5,472,057 | A * | 12/1995 | Winfree | 175/57 |
| 5,590,726 | A | 1/1997 | Jarvela et al. | |
| 2002/0129939 | A1 | 9/2002 | Genolet et al. | |
| 2010/0252331 | A1 | 10/2010 | High et al. | |
| 2011/0011646 | A1 * | 1/2011 | Giroux et al. | 175/61 |
| 2011/0061939 | A1 * | 3/2011 | Boyle | 175/171 |

FOREIGN PATENT DOCUMENTS

| | | |
|---|---|---|
| FI | 95618 | 9/1998 |
| GB | 2170528 A | 8/1986 |
| WO | WO-9409249 A1 | 4/1994 |

OTHER PUBLICATIONS

PCT/ISA/210—International Search Report—March 1, 2012 (Issued in PCT/FI2011/050957).
PCT/ISA/237—Written Opinion of the International Searching Authority—March 1, 2012 (Issued in PCT/F12011/050957).

* cited by examiner

*Primary Examiner* — William P Neuder
(74) *Attorney, Agent, or Firm* — Venable LLP; Eric J. Franklin

(57) ABSTRACT

A method for coupling an earth pipe into the ground when utilizing an apparatus that has a drilling device including a casing part and a drilling unit inside thereof. The drilling unit includes a first drilling member for drilling a center hole and a second drilling member for reaming the center hole for the casing part. The casing part is arranged to be drawn into the hole by the first and/or second drilling member. After drilling a hole for the earth pipe and lifting up the first drilling member, a solidifying mass is led to the bottom of the hole to couple the earth pipe to the surrounding ground. The solidifying mass is brought in the casing part utilizing a flow-through assembly at a lower end of the casing part into a space between an outer surface of the casing part and the hole. Also an apparatus operating.

6 Claims, 6 Drawing Sheets

METHOD AND APPARATUS FOR COUPLING AN EARTH PIPE INTO THE GROUND, USING A SOLIDIFYING MASS

CROSS-REFERENCE TO RELATED APPLICATIONS

This application claims priority under 35 U.S.C. §119 to Finnish patent application 20106154 filed 3 Nov. 2010 and is the national phase of PCT/FI2011/050957 filed 1 Nov. 2011.

FIELD OF THE INVENTION

The invention relates to a method and apparatus for coupling an earth pipe into the ground.

BACKGROUND OF THE INVENTION

Particularly in well drilling e.g. for water wells or heating wells and generally in deep drillings or in groundwater areas, an earth pipe should be tightened into a rock hole in a way that the surface waters or the like impurities may not get mixed with the groundwater. In certain countries there already exist clear orders for these kinds of drillings and in the future they will also concern Nordic countries. E.g. in several states in the United States, the measure in question is at present obligatory.

Particularly e.g. in the United States and in the Southern Europe, a traditional method being used for carrying out the tightening mentioned above in a corresponding context, is with reference to the pictorial shown in FIG. 1 such that first of all a basic hole is drilled into the ground, the diameter of the hole being significantly bigger than the earth pipe to be installed therein, whereafter, after the drilling, a separate earth pipe is installed in the hole. After this, the space between the earth pipe and the basic hole is filled with a tightening mass, such as e.g. injection sement or bentonite clay, simultaneously, when the protecting pipe with the big diameter that was used in the drilling, is pulled out from the hole possibly along with its drilling means.

This is a very slow and expensive method, first of all because a significantly bigger hole needs to be drilled than what the earth pipe to be installed would require and on the other hand because the protecting pipe being used in the basic drilling needs to be pulled out from the drilled hole in a separate work stage. In addition to the above, when exploiting the method, also a disproportionately high amount of tightening mass is spent.

A way to carry out earth drilling in a more developed manner compared to prior art is formerly known e.g. from Finnish Patent No. 95618. A drilling head of a drilling unit, existing inside a casing part that operates after the drilling as an earth pipe, in the drilling apparatus presented in this patent, is formed of a first frame part and an annular second frame part, the drilling surfaces of which are provided with drilling organs, such as drill bits or like, of the first and second drilling means or in other words of a center drill or a pilot and a reamer. In this solution, the first frame part forming the the first drilling means, is being released from the second frame part forming the reamer, in order to pull the same out from a drilled hole after the drilling situation together with the drill rods.

A drilling performed with an apparatus according to the patent described above, has been shown as a pictorial in the appended FIG. 2. At present there exist e.g. different kinds of tightening cement mixtures and procedures in order to achieve tightening of an earth pipe also when performing this type of drilling. In such a drilling, after the casing part has been drilled into a rock and the first drilling means or the pilot has been pulled out, e.g. a freshly mixed batch of cement is dropped on the bottom of the hole, which is e.g. "crushed" on the hole bottom by a rock drill bit. There is, however, such a problem at present, that in the so called ring drill bits according to the patent described above, there doesn't exist any clear route for leading of the tightening mass outside the casing part in order to achieve an external coupling of the casing part with the rock hole. Thus, according to the rightmost view in FIG. 2, the tightening mass may not enter at all or will not get drifted fast enough in every case outside the casing part before the tightening mass gets solidified, which is why actual external tightening of the casing part or anchoring of the same, can not be carried out reliably enough.

SUMMARY OF THE INVENTION

It is an aim of the method and apparatus according to the present invention to achieve a decisive improvement in the functioning of especially the type of a drilling apparatus described above and thus to raise essentially the level of prior art.

As the most important advantages of the method and apparatus according to the invention may be mentioned simplicity and efficiency of the constructions and operating principles enabled by the same first of all thanks to the fact that in connection therewith it is first of all possible to exploit drill bit constructions, the technical functioning of which has been found very good as such. Thanks to the invention, the drilling can be performed reliably so that the groundwater is not allowed to get dirty by leading the tightening mass in the injection phase as an advantageous embodiment by flow channels in connection with the casing shoe with adequately large dimensioned flow cross sections outside the casing part that acts after the drilling of the basic hole as an earth pipe. Thanks to the invention, it is thus possible to minimize the amount of the tightening mass to be used and to remove e.g. an extra work stage related to the method used in traditional processing that is pulling out of the casing part and possibly the drilling means at the drilling end thereof from the drilled hole. With the method and apparatus according to the invention it is thus possible to achieve in addition to the improvement of work efficiency also remarkable savings for the part of performing the drilling itself.

Other advantageous embodiments of the method and apparatus according to the invention have been presented herein.

BRIEF DESCRIPTION OF THE DRAWINGS

Figure 1:
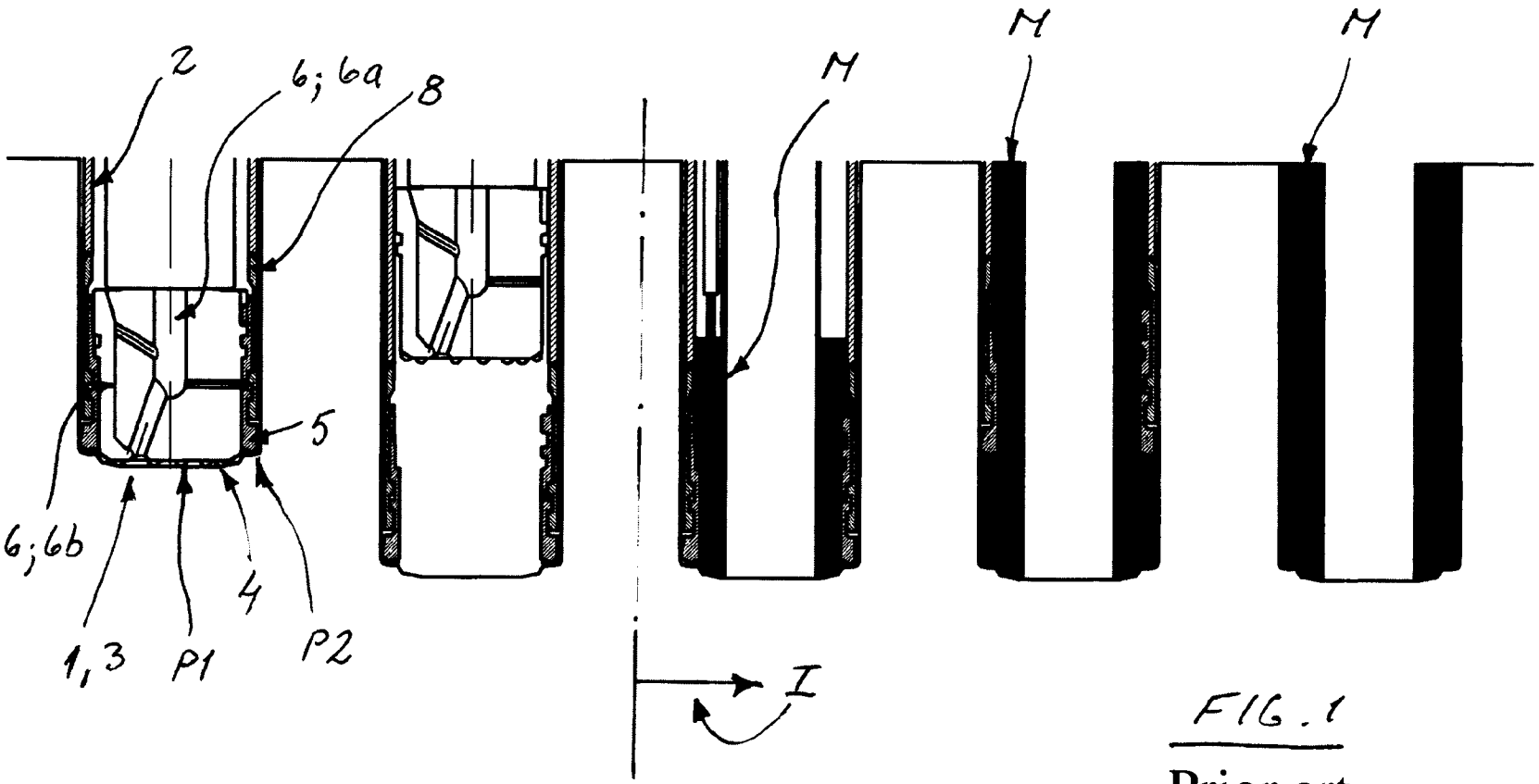
FIG. 1 Prior art
Figure 2:
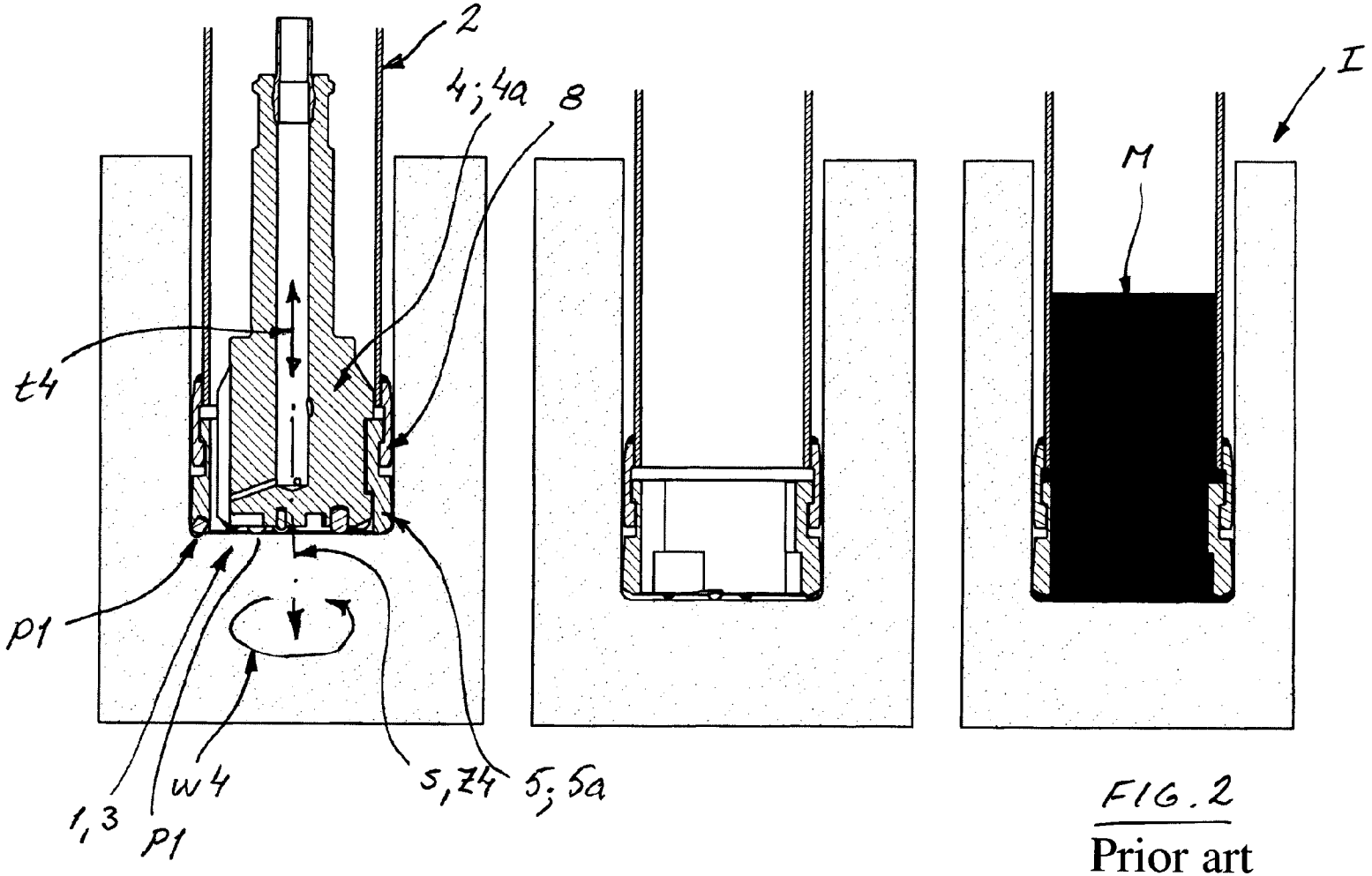
FIG. 2 Prior art
Figure 3:
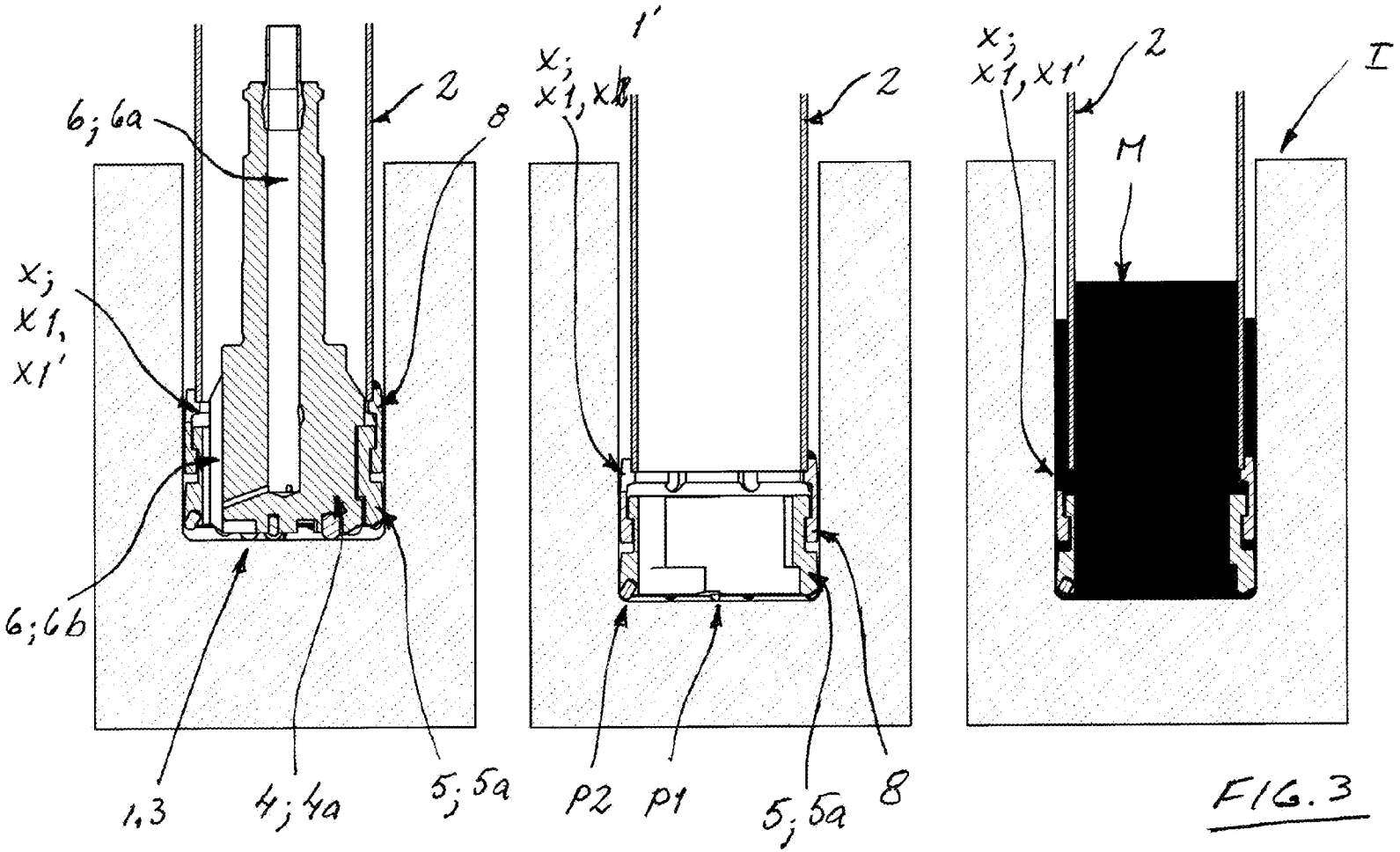
Figure 4:
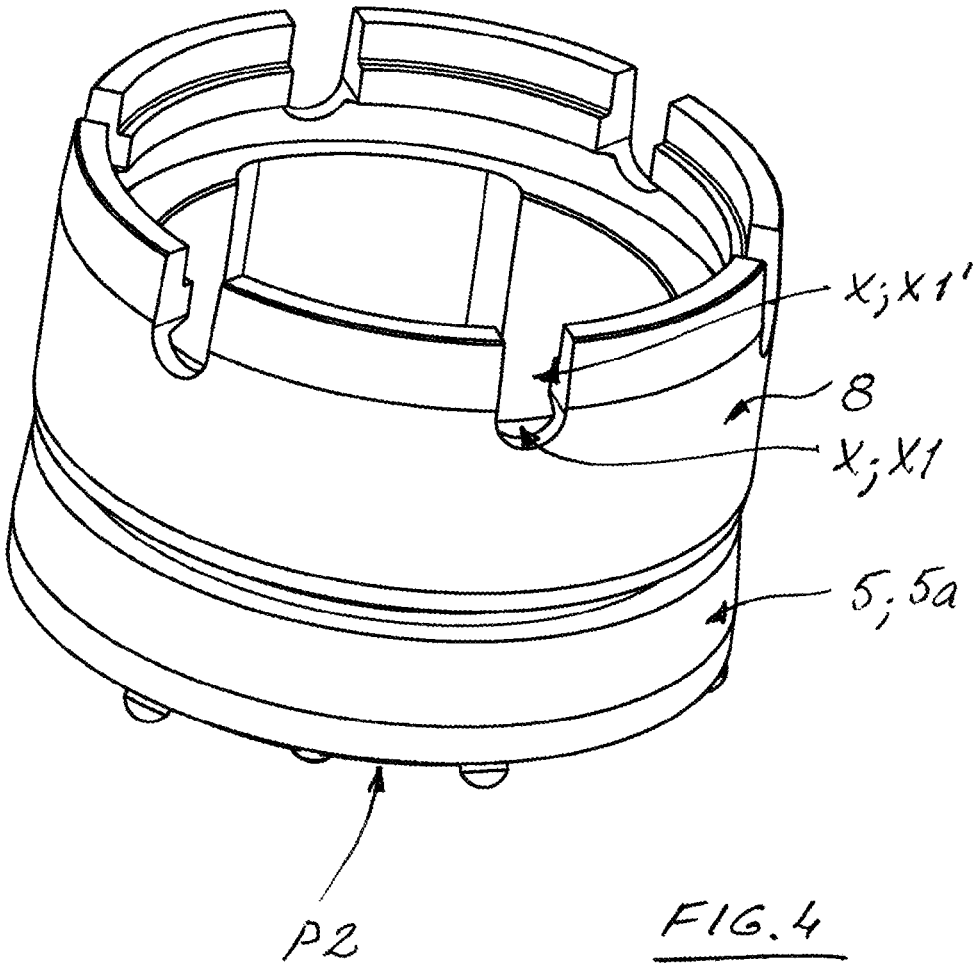
Figure 5:
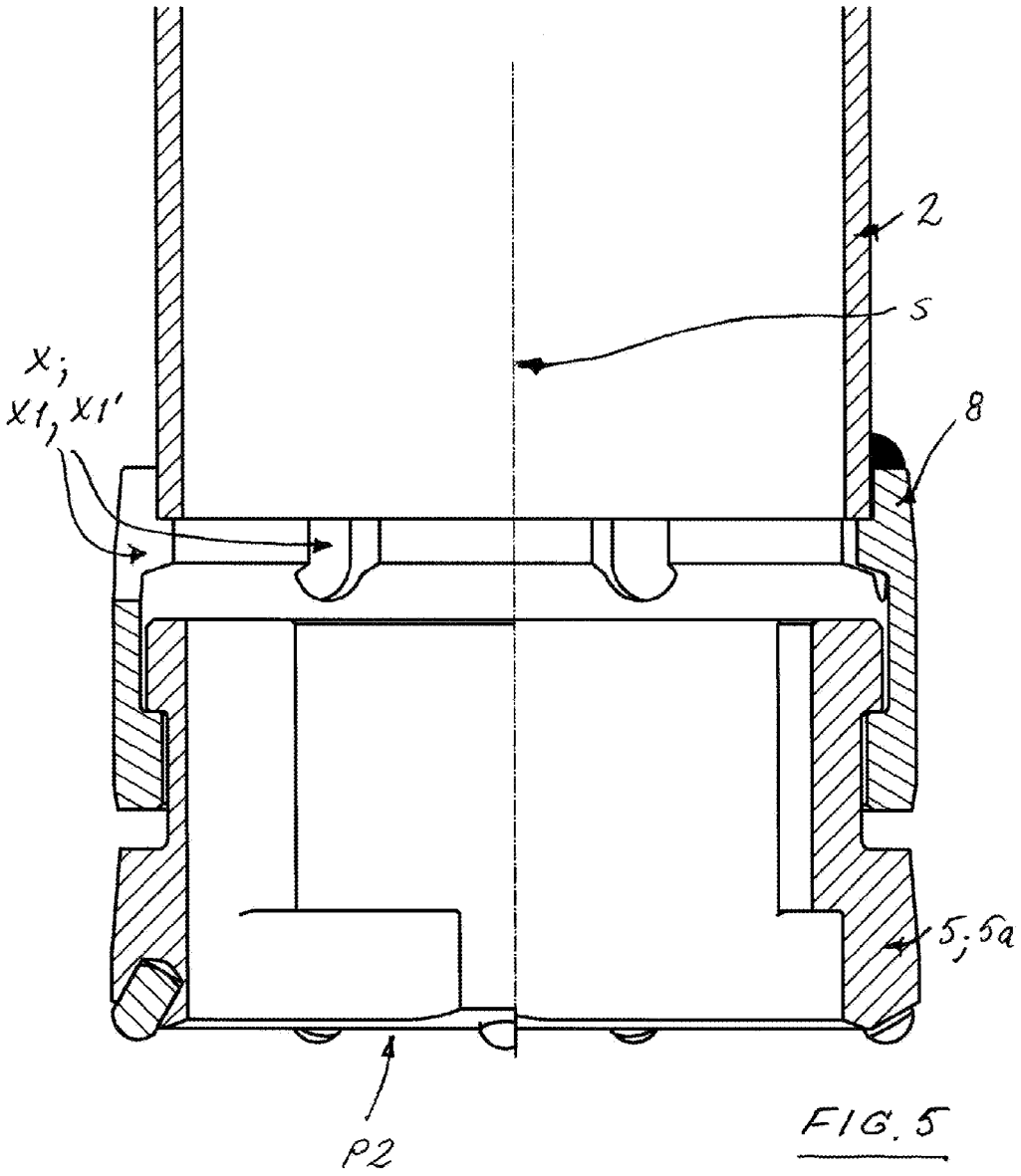
Figure 6:
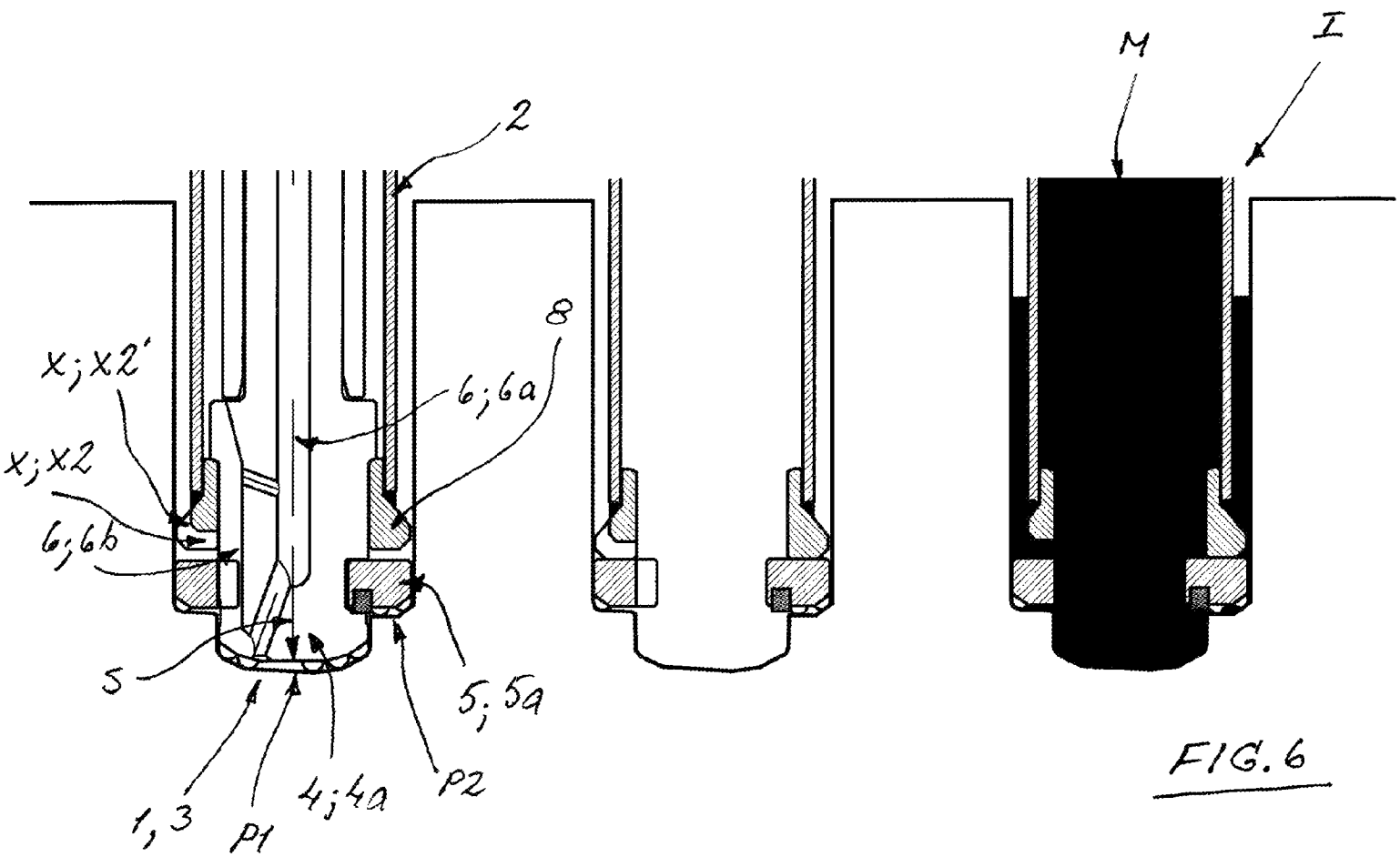

In the following description the invention is illustrated in detail with reference to the appended drawings, in which, in FIG. 1 is shown a cross-sectional view with a series of five pictures a method according to prior art in the coupling of an earth pipe into the ground, in FIG. 2 is shown a cross-sectional view with a series of three pictures the coupling into the ground of an earth pipe to be installed by a drilling apparatus according to prior art, in FIG. 3 is shown a cross-sectional view with a series of three pictures the coupling of an earth pipe into the ground performed by an advantageous apparatus applying the method according to the invention, in FIG. 4 is shown as a perspective view an advantageous combination of a reamer and a casing shoe to be used in connection with a drilling apparatus according to the invention, in FIG. 5 is shown the implementation according to FIG. 4 as a cross-sectional view, and in FIG. 6 is shown a cross-sectional view with a series of three pictures a drilling being carried out by an alternative apparatus with respect to the one shown in FIG. 3.

DETAILED DESCRIPTION OF EMBODIMENTS OF THE INVENTION

The invention relates to a method for coupling an earth pipe into the ground when exploiting an apparatus that has a drilling device 1, consisting of a casing part 2 and a drilling unit 3 that exists at least during a drilling situation essentially inside thereof, which unit includes: first drilling means 4 at a drilling head thereof for drilling a center hole and second drilling means 5 for reaming the center hole for the casing part 2, whereby the essentially rotationally symmetrical first drilling means and the second drilling means 4, 5 are coupled mutually first of all in a power transmitting manner in order to carry out cooperation thereof at least during a drilling situation for a rotational motion w4, a feeding motion z4 and/or a hammering motion t4 and on the other hand removably in order to enable removal of the first drilling means from a drilled hole and, whereby the casing part 2 is arranged to be drawn into the hole to be drilled by the first and/or second drilling means; and advantageously a flushing flow arrangement 6 first of all to feed a flushing medium by first flushing means 6*a* for the drilling and on the other hand to remove the flushing medium and drilling waste getting generated by second flushing means 6*b* inside the casing part 2.

After the drilling of the basic hole for the earth pipe or e.g. when the casing part 2 is drilled into the rock and after the first drilling means 4 have been lifted up, in a following injection phase I, solidifying mass M, such as injection cement, bentonite clay or like, is being led to the bottom of the basic hole in order to couple the earth pipe to be installed in the basic hole with the surrounding ground, such as rock, for tightening the earth pipe into the rock hole, for anchoring of the same in place and/or for the like purpose. After the drilling of the basic hole, the casing part 2 acting as an earth pipe is being coupled in the injection phase I into the ground according to the rightmost views of the pictorials in FIGS. 3 and 6 by leading solidifying mass M, being brought internally in the casing part 2, by means of a flow-through assembly X essentially at a lower end of the casing part 2 and/or in front thereof, when viewed in the drilling direction s, into a space between an outer surface of the casing part 2 and the basic hole.

By leading the injection mass in the drilled hole by a flow-through assembly X essentially at a lower end of the casing part and/or in front thereof into the space surrounding the casing part 2 and by using a drilling device 1 equipped with symmetrical drill bits and being of the type presented in the appended drawings, the amount of the tightening mass that is needed can be minimized as well as the through-drilling of a "bottom plug" in a final drilling stage by the rock drill bit.

The method according to the invention is being exploited advantageously with reference to the appended drawings when using an apparatus, in which the drilling head I of the drilling device's 1 drilling unit 3 is formed of a first frame part 4*a* and a second frame part 5*a*, wherein drilling surfaces P1, P2 of the frame parts are provided with drilling organs of the first and the second drilling means 4, 5, such as an integrated drilling part, separate drilling pieces, bits or like. As an advantageous embodiment of the method with reference to the pictorial shown in FIG. 3, when a drilling unit 3 is being used, by means of which the casing part 2 is being drawn into the hole to be drilled by means of a casing shoe 8 by influence of power being transmitted thereto from the second drilling means 5, the solidifying mass M is being led from inside the casing part 2 outside the same through one or several essentially radial flow-through channels X; X1 essentially at a back edge of the casing shoe 8.

As an alternative embodiment with respect to the above with reference to the pictorial shown in FIG. 6, when a drilling unit 3 is being used, by means of which the casing part 2 is being drawn into the hole to be drilled by means of a casing shoe 8 by influence of power transmitted thereto from the first drilling means 4, the solidifying mass M is being led from inside the casing part 2 outside the same through one or several, essentially radial flow-through channels X; X2 essentially at a front edge of the casing part 8.

As a further advantageous embodiment of the method according to the invention, the solidifying mass M is being led in the injection phase I from one or several flow-through channels X; X1/X2 belonging to the flow-through assembly essentially backwards with respect to the drilling direction s by a guide groove or grooves X1'/X2' essentially axially into an intermediate space surrounding the casing part 2. In this context with reference e.g. to FIG. 4 and to the midmost view of the pictorial shown in FIG. 3, it can be seen that merely by radial flow channels X; X1 the guiding of the tightening mass outside the casing part could not be made sure with large enough flow ways, wherein by leaving the said channels open with axial flow grooves X1' till the back edge of the casing shoe, a flow way that is open for the casing shoe's whole thickness can be exploited. This concerns also the embodiment according to FIG. 6.

The invention relates also to an apparatus according to the description above and as shown in the appended drawings for coupling an earth pipe into the ground, in which a flow-through assembly X is arranged in the drilling device 1 essentially at a lower end of the casing part 2 and/or in front thereof, when viewed in the drilling direction s, in order to lead the solidifying mass M to be brought internally in the casing part 2 into a space between an outer surface of the casing part 2 and the basic hole e.g. according to the rightmost views in the pictorials of FIGS. 4 and 6.

The invention is exploited advantageously, when exploiting an apparatus of the type presented in the appended drawings, in which the drilling head I of the drilling device's 1 drilling unit 3 is formed of a first frame part 4*a* and a second frame part 5*a*, wherein drilling surfaces P1, P2 of the frame parts are provided with drilling organs of the first and the second drilling means 4, 5, such as an integrated drilling part, separate drilling pieces, bits or like. Particularly in the embodiment shown in FIG. 3, when the arrangement pulling the casing part 2 into the hole to be drilled acts by means of the casing shoe 8 by influence of power transmitted thereto from the second drilling means 5, essentially at a back edge of the casing shoe 8 is arranged one or several essentially radial flow-through channels X; X1 for leading of the solidifying mass M from inside the casing part 2 outside the same.

Particularly in the embodiment according to FIG. 6, when the assembly pulling the casing part 2 into the hole to be drilled acts by means of the casing shoe 8 by influence of power transmitted thereto from the first drilling means 4, essentially at a front edge of the casing part 8 is arranged one or several essentially radial flow-through channels X; X2 in order to lead solidifying mass M from inside the casing part 2 outside the same.

In the embodiments described above, the radial flow-through channels have been arranged in connection with the casing shoe 8, but instead or in addition thereto it is also possible to arrange the radial flow-through of the tightening massa e.g. by perforations or nozzles etc. existing at the lower end of the casing part 2 (which have not, however, been presented in detail in the drawings).

Furthermore as an advantageous embodiment particularly with reference to FIGS. 4-6, the flow-through assembly comprises a guide groove or grooves X1', X2' directed essentially backwards with respect to the drilling direction s from one or several essentially radial flow-through channels X; X1, X2, in order to lead the solidifying mass M essentially axially s into an intermediate space surrounding the casing part 2. In the way described above, by an injection that takes place essentially from below upwards, passage of the tightening mass into the space surrounding the casing part 2 can be made sure efficiently from all over and as fast as possible without e.g. formation of air pockets.

It is clear that the invention is not limited to the embodiments presented or described above, but instead it can be modified within the basic idea of the invention according to the needs at any given time. It is thus clear that the constructions of the drilling heads being illustrated in the appended drawings may vary in practice very much merely when being carried out with differing diameters. Instead of the type of embodiments shown in the appended drawings, it is naturally possible to use as the drilling device also other drilling devices that are applicable for the same purpose, in which a casing part is being exploited that is most advantageously not rotated when being drawn into the ground. It is not that significant for the method and the apparatus according to the invention, either, how the first and second drilling means are coupled to work, so that most heterogeneous solutions can be exploited as the power transmission assemblies between the same starting from a screw joint locking. The casing shoe can also be placed in an built-in manner at the end of the casing part etc.

The invention claimed is:

1. A method for coupling a casing of a drilling device into the ground when utilizing a drilling device comprising the casing and a drilling unit, wherein the drilling unit is arranged at least during drilling essentially inside the casing, wherein the drilling unit includes: a first drilling member at a drilling head of the drilling unit for drilling a center hole and a second drilling member for reaming the center hole for the casing, whereby the first drilling member and the second drilling member are essentially rotationally symmetrical and removably coupled in a power transmitting manner in order to carry out cooperation thereof at least during drilling for at least one of a rotational motion, a feeding motion or a hammering motion, wherein the first drilling member is removable from a drilled hole and, whereby the casing is arranged to be drawn into the drilled hole by at least one of the first drilling member or the second drilling member; and a flushing flow arrangement to feed a flushing medium through a first flushing member and to remove the flushing medium and drilling waste generated by drilling through a second flushing member inside the casing, the method comprising after the drilling of the hole for the casing and after removing the first drilling member from the hole:

injecting a solidifying mass to the bottom of the hole to carry out at least one of coupling the casing with the surrounding ground, tightening the casing in the hole, or anchoring the casing in the hole, wherein the solidifying mass is injected internally in the casing and through a flow-through assembly essentially at a lower end of the casing and/or in front of the casing with respect to a drilling direction into a space between an outer surface of the casing and the hole, wherein the drilling head comprises a first frame part and a second frame part, wherein drilling surfaces of the first frame part and the second frame part comprise drilling organs of the first drilling member and the second drilling member, wherein the drilling unit draws the casing into the hole with a casing shoe through transmitting power to the casing shoe from the second drilling member, wherein the solidifying mass is fed from inside the casing to outside the casing through at least one essentially radial flow-through channel essentially at a back edge of the casing shoe to inject the solidifying mass in a direction opposite the drilling direction.

2. A method for coupling a casing of a drilling device into the ground when utilizing a drilling device comprising the casing and a drilling unit, wherein the drilling unit is arranged at least during drilling essentially inside the casing, wherein the drilling unit includes: a first drilling member at a drilling head of the drilling unit for drilling a center hole and a second drilling member for reaming the center hole for the casing, whereby the first drilling member and the second drilling member are essentially rotationally symmetrical and removably coupled in a power transmitting manner in order to carry out cooperation thereof at least during drilling for at least one of a rotational motion, a feeding motion or a hammering motion, wherein the first drilling member is removable from a drilled hole and, whereby the casing is arranged to be drawn into the drilled hole by at least one of the first drilling member or the second drilling member; and a flushing flow arrangement to feed a flushing medium through a first flushing member and to remove the flushing medium and drilling waste generated by drilling through a second flushing member inside the casing, the method comprising after the drilling of the hole for the casing and after removing the first drilling member from the hole:

injecting a solidifying mass to the bottom of the hole to carry out at least one of coupling the casing with the surrounding ground, tightening the casing in the hole, or anchoring the casing in the hole, wherein the solidifying mass is injected internally in the casing and through a flow-through assembly essentially at a lower end of the casing and/or in front of the casing with respect to a drilling direction into a space between an outer surface of the casing and the hole, such that the solidifying mass flows opposite to the drilling direction in the space, wherein the unit draws the casing into the hole with a casing shoe through power transmitted to the casing shoe from the first drilling member, wherein the solidifying mass is fed from inside the casing part outside the casing part through at least one essentially radial flow-through channel essentially at a front edge of the casing.

3. A method for coupling a casing of a drilling device into the ground when utilizing a drilling device comprising the casing and a drilling unit, wherein the drilling unit is arranged at least during drilling essentially inside the casing, wherein the drilling unit includes: a first drilling member at a drilling head of the drilling unit for drilling a center hole and a second drilling member for reaming the center hole for the casing, whereby the first drilling member and the second drilling member are essentially rotationally symmetrical and removably coupled in a power transmitting manner in order to carry out cooperation thereof at least during drilling for at least one of a rotational motion, a feeding motion or a hammering motion, wherein the first drilling member is removable from a drilled hole and, whereby the casing is arranged to be drawn into the drilled hole by at least one of the first drilling member or the second drilling member; and a flushing flow arrangement to feed a flushing medium through a first flushing member and to remove the flushing medium and drilling waste generated by drilling through a second flushing member inside the casing, the method comprising after the drilling of the hole for the casing and after removing the first drilling member from the hole:

injecting a solidifying mass to the bottom of the hole to carry out at least one of coupling the casing with the surrounding ground, tightening the casing in the hole, or anchoring the casing in the hole, wherein the solidifying mass is injected internally in the casing and through a flow-through assembly essentially at a lower end of the casing and/or in front of the casing with respect to a drilling direction into a space between an outer surface of the casing and the hole, such that the solidifying mass flows opposite to the drilling direction in the space, wherein the solidifying mass is fed in the injection phase from at least one flow-through channel of the flow-through assembly essentially backwards with respect to the drilling direction by at least one guide groove essentially axially into an intermediate space surrounding the casing.

4. An apparatus for coupling an earth pipe into the ground, the apparatus comprising:

a drilling device comprising a casing and a drilling unit arranged at least during drilling essentially inside the casing, wherein the drilling unit comprises a first essentially rotationally symmetrical drilling member at a drilling head of the drilling unit for drilling a center hole and a second drilling member for reaming the center hole for the casing, whereby the first drilling member and the second drilling member are removably coupled in a power transmitting manner to carry out cooperation thereof at least during drilling for at least one of a rotational motion, a feeding motion or a hammering motion and to enable removal of the first drilling member from a drilled hole and, whereby the casing is arranged to be drawn into the hole to be drilled by at least one of the first drilling member or the second drilling member; and a flushing flow arrangement to feed a flushing medium through a first flushing member and to remove the flushing medium and drilling waste through a second flushing member inside the casing, whereby the casing is arranged to be coupled with the surrounding ground to tighten the casing into the hole, to anchor the casing, by feeding a solidifying mass to a bottom of the hole after the drilling of the hole and after removing the first drilling member from the hole, wherein a flow-through assembly is arranged in the drilling device essentially at at least one of a lower end of the casing or in front of the casing with respect to a drilling direction, to feed the solidifying mass an interior of the casing into a space between an outer surface of the casing and the hole to inject the solidifying mass in a direction opposite the drilling direction, wherein the drilling head comprises a first frame part and a second frame part, wherein drilling surfaces of the first frame part and the second frame part comprise drilling organs of the first drilling member and the second drilling member, wherein a casing shoe pulls the casing into the hole through power transmitted to the casing shoe from the second drilling member, essentially at a back edge of the casing shoe is arranged at least one essentially radial flow-through channel for feeding the solidifying mass from inside the casing to outside the casing.

5. An apparatus for coupling an earth pipe into the ground, the apparatus comprising:

a drilling device comprising a casing and a drilling unit arranged at least during drilling essentially inside the casing, wherein the drilling unit comprises a first essentially rotationally symmetrical drilling member at a drilling head of the drilling unit for drilling a center hole and a second drilling member for reaming the center hole for the casing, whereby the first drilling member and the second drilling member are removably coupled in a power transmitting manner to carry out cooperation thereof at least during drilling for at least one of a rotational motion, a feeding motion or a hammering motion and to enable removal of the first drilling member from a drilled hole and, whereby the casing is arranged to be drawn into the hole to be drilled by at least one of the first drilling member or the second drilling member; and a flushing flow arrangement to feed a flushing medium through a first flushing member and to remove the flushing medium and drilling waste through a second flushing member inside the casing, whereby the casing is arranged to be coupled with the surrounding ground to tighten the casing into the hole, to anchor the casing, by feeding a solidifying mass to a bottom of the hole after the drilling of the hole and after removing the first drilling member from the hole, wherein a flow-through assembly is arranged in the drilling device essentially at at least one of a lower end of the casing or in front of the casing with respect to a drilling direction, to feed the solidifying mass an interior of the casing into a space between an outer surface of the casing and the hole to inject the solidifying mass in a direction opposite the drilling direction, wherein a casing shoe bulls the casing into the hole through by influence of power transmitted thereto to the casing show from the first drilling member, and wherein at least one essentially radial flow-through channel is arranged essentially at a front edge of the casing to feed the solidifying mass from inside the casing part outside the casing part.

6. An apparatus for coupling an earth pipe into the ground, the apparatus comprising:

a drilling device comprising a casing and a drilling unit arranged at least during drilling essentially inside the casing, wherein the drilling unit comprises a first essentially rotationally symmetrical drilling member at a drilling head of the drilling unit for drilling a center hole and a second drilling member for reaming the center hole for the casing, whereby the first drilling member and the second drilling member are removably coupled in a power transmitting manner to carry out cooperation thereof at least during drilling for at least one of a rotational motion, a feeding motion or a hammering motion and to enable removal of the first drilling member from a drilled hole and, whereby the casing is arranged to be drawn into the hole to be drilled by at least one of the first drilling member or the second drilling member; and a flushing flow arrangement to feed a flushing medium through a first flushing member and to remove the flushing medium and drilling waste through a second flushing member inside the casing, whereby the casing is arranged to be coupled with the surrounding ground to tighten the casing into the hole, to anchor the casing, by feeding a solidifying mass to a bottom of the hole after the drilling of the hole and after removing the first drilling member from the hole, wherein a flow-through assembly is arranged in the drilling device essentially at at least one of a lower end of the casing or in front of the casing with respect to a drilling direction, to feed the solidifying mass an interior of the casing into a space between an outer surface of the casing and the hole to inject the solidifying mass in a direction opposite the drilling direction, wherein a flow-through assembly comprises at least one guide groove directed essentially backwards with respect to the drilling direction from at least one essentially radial flow-through channel, to lead the solidifying mass essentially axially into an intermediate space surrounding the casing.

* * * * *

UNITED STATES PATENT AND TRADEMARK OFFICE

CERTIFICATE OF CORRECTION

PATENT NO. : 9,175,519 B2
APPLICATION NO. : 13/885882
DATED : November 3, 2015
INVENTOR(S) : Kai Gylling It is certified that error appears in the above-identified patent and that said Letters Patent is hereby corrected as shown below:

Claims

Column 8, lines 36-38, claim 5, should read as:

5. An apparatus for coupling an earth pipe into the ground, the apparatus comprising:

a drilling device comprising a casing and a drilling unit arranged at least during drilling essentially inside the casing, wherein the drilling unit comprises a first essentially rotationally symmetrical drilling member at a drilling head of the drilling unit for drilling a center hole and a second drilling member for reaming the center hole for the casing, whereby the first drilling member and the second drilling member are removably coupled in a power transmitting manner to carry out cooperation thereof at least during drilling for at least one of a rotational motion, a feeding motion or a hammering motion and to enable removal of the first drilling member from a drilled hole and, whereby the casing is arranged to be drawn into the hole to be drilled by at least one of the first drilling member or the second drilling member; and a flushing flow arrangement to feed a flushing medium through a first flushing member and to remove the flushing medium and drilling waste through a second flushing member inside the casing, whereby the casing is arranged to be coupled with the surrounding ground to tighten the casing into the hole, to anchor the casing, by feeding a solidifying mass to a bottom of the hole after the drilling of the hole and after removing the first drilling member from the hole, wherein a flow-through assembly is arranged in the drilling device Signed and Sealed this
Sixteenth Day of August, 2016

Michelle K. Lee

Michelle K. Lee
*Director of the United States Patent and Trademark Office* essentially at at least one of a lower end of the casing or in front of the casing with respect to a drilling direction, to feed the solidifying mass an interior of the casing into a space between an outer surface of the casing and the hole to inject the solidifying mass in a direction opposite the drilling direction, wherein a casing shoe pulls the casing into the hole through power transmitted to the casing show from the first drilling member, and wherein at least one essentially radial flow-through channel is arranged essentially at a front edge of the casing to feed the solidifying mass from inside the casing part outside the casing part.